United States Patent [19]

Kinzler et al.

[11] Patent Number: 4,578,664

[45] Date of Patent: Mar. 25, 1986

[54] RADIO INTERFERENCE SUPPRESSION CHOKE WITH A LOW LEAKAGE FIELD

[75] Inventors: Hans Kinzler; Jürgen Kaiser, both of Regensburg, Fed. Rep. of Germany

[73] Assignee: Siemens Aktiengesellschaft, Berlin and Munich, Fed. Rep. of Germany

[21] Appl. No.: 761,295

[22] Filed: Jul. 29, 1985

Related U.S. Application Data

[63] Continuation of Ser. No. 498,882, May 27, 1983, abandoned.

[30] Foreign Application Priority Data

Jun. 2, 1982 [DE] Fed. Rep. of Germany ..... 3220737

[51] Int. Cl.[4] ..... H01F 27/30

[52] U.S. Cl. ..... 336/90; 336/182; 336/198; 336/229

[58] Field of Search ..... 336/198, 208, 196, 90, 336/229, 184, 185, 98, 180, 182

[56] References Cited

U.S. PATENT DOCUMENTS

| | | | |
|---|---|---|---|
| 1,897,604 | 2/1933 | Clemons | 336/198 |
| 2,216,863 | 10/1940 | Visman | 336/198 |
| 3,027,526 | 3/1962 | LaPatka et al. | 336/229 X |
| 3,032,729 | 5/1962 | Fluegel | 336/229 X |
| 3,068,381 | 12/1962 | Vazguez | 336/229 X |

FOREIGN PATENT DOCUMENTS

| | | | |
|---|---|---|---|
| 642616 | 6/1962 | Canada | 336/229 |
| 1350868 | 12/1963 | France | 336/229 |
| 1105294 | 3/1968 | United Kingdom | 336/229 |

*Primary Examiner*—Thomas J. Kozma

*Attorney, Agent, or Firm*—Herbert L. Lerner; Laurence A. Greenberg

[57] ABSTRACT

A radio interference suppression choke with a low leakage field, includes a ring core formed of magnetically soft material, a plurality of windings each formed of a respective continuous wire wound on the core in separate respective series-connected winding sections, the windings having mutually adjacent transition regions, and an insulating cap disposed on the core separating the windings at least at the mutually adjacent transition regions thereof.

1 Claim, 5 Drawing Figures

RADIO INTERFERENCE SUPPRESSION CHOKE WITH A LOW LEAKAGE FIELD

This application is a continuation of application Ser. No. 498,882, filed May 27, 1983, now abandoned.

The invention relates to a radio interference suppression choke, especially a current-compensated multiple ring core choke, including several windings placed on a preferably electrically insulated ring core formed of magnetically soft material, especially ferrite, the windings being separated into series-connected winding sections wound on mutually diametrical opposite sections of the ring core, and preferably having the same number of turns.

In the heretofore-known multiple ring core chokes of this type, the winding sections are connected in series by a separate operation which follows the winding operations. In double ring core chokes, this may necessitate two twisting operations, i.e., two operations in which the respective ends and starts of the winding sections to be interconnected are twisted together; immersion soldering of the twisted winding wires; shortening them, and finally insulating them, which is customarily done by means of insulating material in tape form. The manufacturing costs are correspondingly increased in the case of ring core chokes with a larger total number of windings and therefore, winding sections.

It is accordingly an object of the invention to provide a radio interference suppression choke with a low leakage field, especially a current-compensated multiple ring core choke, which overcomes the hereinaforementioned disadvantages of the heretofore-known devices of this general type, and which is characterized by an internal series circuit of the winding sections and by potential isolation, which avoids the above-mentioned disadvantages in production.

With the foregoing and other objects in view there is provided, in accordance with the invention, a radio interference suppression choke with a low leakage field, especially a current-compensating multiple ring core choke, comprising an electrically insulated ring core formed of magnetically soft material, a plurality of windings each formed of a respective continuous wire wound on preferably mutually diametrically opposite sections of the core without interruption in separate respective series-connected winding sections particularly with an equal number of turns, and with van insulating cap pushed on the core, and optionally on to one of the windings, separating the windings.

This type of winding renders the above-mentioned expensive method of forming a contact of the winding section ends and starts, unnecessary. After a winding section is completed, the wire end need only be brought to the diametrically opposite ring core section, and finally, the second winding section is placed on the ring core. The insulating cap not only provides the insulation of the windings which is otherwise provided only at considerable cost, but with proper construction, it also ensures that the winding sections are properly fixed in place.

In accordance with another feature of the invention, the windings are offset relative to each other by substantially 90°, forming a double choke.

In accordance with a further feature of the invention, the insulating cap is in the form of an annular cup.

In accordance with an added feature of the invention, the windings include a first winding having winding sections wound directly on the core and a second winding having winding sections wound on the cap, and the cap has segments of enlarged cross section disposed on the winding sections of the first winding and segments of reduced cross section supporting the winding sections of the second winding.

In accordance with a concomitant feature of the invention, the cup has a bottom and mutually diametrically opposite, parallel and non-overlapping or congruent segments disposed at a distance from the bottom of the cup defining radially outwardly and circumferentially open canals.

Other features which are considered as characteristic for the invention are set forth in the appended claims.

Although the invention is illustrated and described herein as embodied in a radio interference suppression choke with a low leakage field, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
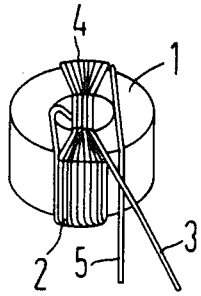
FIGS. 1 and 3 are diagrammatic, perspective views of a first embodiment of a double ring core choke, FIGS. 1 and 2 together forming a partially exploded and partically incomplete view of the total structure shown in FIG. 3.
Figure 3:
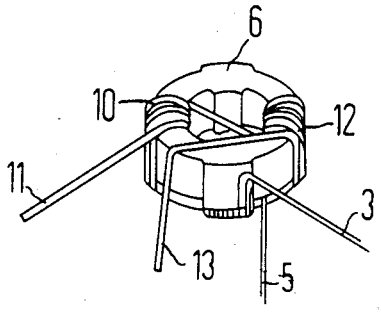
Figure 2:
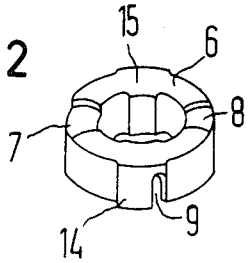

Referring now to the figures of the drawing and first particularly to the embodiment according to FIGS. 1–3 thereof, there is seen a winding structure of a current-compensated double ring core choke with a low leakage field. According to FIG. 1, a first winding section 2 is wound on an electrically insulated ferrite ring core 1 and a second winding section 4 is wound diametrically opposite the first winding section 2. The end of the winding section 2 is brought continuously to the start of the winding section 4, i.e., without interruption. The start 3 and the end 5 of the entire or combined winding 2, 4 extend outwardly on the same side of the core in the embodiment shown, although this is not absolutely necessary. The start and the end of the winding can also be brought toward radially opposite sides.

An insulating cap 6 which is constructed as an annular cup, is pushed onto the ring core 1 wound in accordance with FIG. 1. The insulating cap has an enlarged cross section at sections or segments 14, 15 thereof which are slipped over the winding sections 2, 4. The cap 6 is also provided with a cutout 9 at the edge thereof, which permits the start of the winding 3 to be brought out as shown in FIG. 3.

Figure 4:
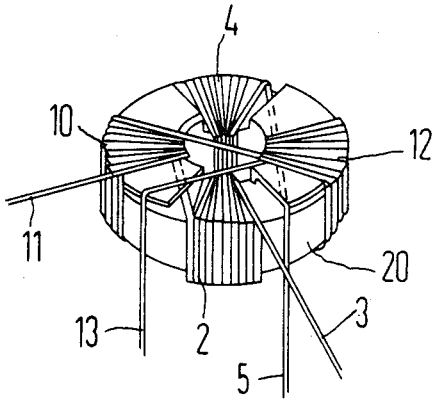
FIG. 4 is a perspective view of a second embodiment of a double ring core choke.

The insulating cap 6 also has sections or segments 7, 8 which are offset relative to the sections or segments 14, 15 by 90° and each have a smaller cross section than the sections 14, 15. This ensures that winding sections 10, 12 which are wound on the insulating cap 6 with the ring core 1 according to FIG. 3, will be fixed in place;

the start 11 and the end 13 of the windings 10, 12 can likewise be pulled toward radially opposite sides, contrary to the view according to FIG. 4.

Figure 5:
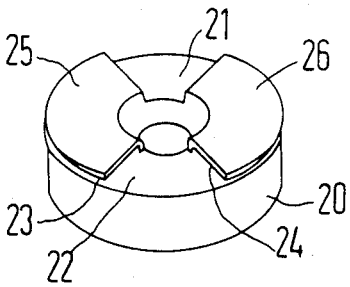
FIG. 5 is a perspective view of the insulating cap of the embodiment according to FIG. 4.

In the embodiment according to FIGS. 4 and 5, like parts, particularly the windings and their winding ends and starts, are designated with the same reference symbols. An insulating cap 20 shown in FIG. 5 is slipped directly on the ring core, i.e., without first winding sections of the winding on the core. The insulating cap 20 has segments 25, 26 which are aligned parallel, congruent or non-overlapping and diametrically opposite each other at a distance from the bottom of the cup. The segments are open radially outwardly and in the circumferential direction of the bottom of the cup and thus form pocket-shaped slots or insulating canals 23, 24 between the segments and the cup for a portion of the windings between the winding sections 2, 4 or for the return of the winding end 5. By equipping the insulating cap 20 with segments 25, 26, sections 21, 22 of reduced cross section, comparable to the sections 7, 8 according to FIG. 2, are created, in order to likewise ensure that the winding sections 2, 4 will be fixed in place.

The foregoing is a description corresponding in substance to German application No. P 32 20 737.9, dated June 2, 1982, the International priority of which is being claimed for the instant application and which is hereby made part of this application. Any material discrepancies between the foregoing specification and the aforementioned corresponding German application are to be resolved in favor of the latter.

We claim:

1. Radio interference suppression choke with a low leakage field, comprising;

an electrically insulated ferrite ring core;

a first winding having first and second series-connected winding sections wound directly on said core diametrically opposite each other;

an annular one-piece insulating cup disposed on said core and on said first winding; and a second winding having first and second series-connected winding sections wound on said cup diametrically opposite each other;

said first and second windings being offset relative to each other by substantially 90°, forming a double choke and said cup having segments of enlarged cross section and width disposed on and spanning said winding sections of said first winding and segments of reduced cross section supporting said winding sections of said second winding.

* * * * *